US005097855A

United States Patent [19]

Martinsson et al.

[11] Patent Number: 5,097,855

[45] Date of Patent: Mar. 24, 1992

[54] METHOD FOR SELF-CLEANING OF A STRAINER SYSTEM IN A DISHWASHER AND A DISH-WASHER HAVING MEANS FOR CARRYING OUT THE METHOD

[75] Inventors: Christer Martinsson; Barbro Nordqvist, both of Lidköping, Sweden

[73] Assignee: ABB Cylinda AB, Sweden

[21] Appl. No.: 274,553

[22] Filed: Nov. 22, 1988

[30] Foreign Application Priority Data

Nov. 26, 1987 [SE] Sweden ..... 8704705

[51] Int. Cl.[5] ..... B08B 15/00

[52] U.S. Cl. ..... 134/57 D; 134/104.4; 134/108; 134/111

[58] Field of Search ..... 134/111, 108, 104.4, 134/110, 109, 51 D, 56 D, 57 D

[56] References Cited

U.S. PATENT DOCUMENTS

| | | | |
|---|---|---|---|
| 2,834,631 | 7/1959 | Levit et al. | 134/111 |
| 4,150,680 | 4/1979 | Johnson et al. | 134/104.4 |
| 4,389,351 | 6/1983 | O'Brien | 134/104.4 X |
| 4,754,772 | 7/1988 | Nord et al. | 134/111 |

FOREIGN PATENT DOCUMENTS

| | | | |
|---|---|---|---|
| 0222306 | 5/1987 | European Pat. Off. . | |
| 2555153 | 7/1977 | Fed. Rep. of Germany | 134/111 |
| 2656556 | 6/1978 | Fed. Rep. of Germany | 134/111 |
| 2656557 | 6/1978 | Fed. Rep. of Germany | 134/111 |
| 2657764 | 6/1978 | Fed. Rep. of Germany . | |
| 2757616 | 6/1979 | Fed. Rep. of Germany | 134/111 |

*Primary Examiner*—Frankie L. Stinson

*Attorney, Agent, or Firm*—Pollock, Vande Sande & Priddy

[57] ABSTRACT

A dishwasher has a container with baskets for the articles to be washed, a flushing system with a scavenging pump, spray arms, a strainer system with a fine strainer and a coarse strainer, and a discharge pump. The operation of the dishwasher is controlled by a control system which, after a prewashing controls partial drainage of the water to such an extent that the water level is lower than the upper surface of the fine strainer. With this reduced water level, the fine strainer is cleaned by running the residual amount of water through the flushing system during a predetermined time interval. Dirt flushed away from the strainer surface is collected in the central part of the strainer system and is discharged after completion of the flushing together with the residual water amount.

12 Claims, 4 Drawing Sheets

METHOD FOR SELF-CLEANING OF A STRAINER SYSTEM IN A DISHWASHER AND A DISH-WASHER HAVING MEANS FOR CARRYING OUT THE METHOD

TECHNICAL FIELD

The invention relates to a method for self-cleaning of a strainer system in a dishwashing machine, which has a container for articles to be washed up, a strainer system arranged in the lower part of the container with a first strainer surface arranged at a higher level than the lowermost part of the container, a flushing system adapted to suck liquid through the strainer system from the lower part of the container and to spray this liquid into the container through spray nozzles, as well as drainage means for drainage of washing liquid from the lowermost part of the container, this washing-up process being performed in a plurality of consecutive wash-up steps.

The invention also relates to a dishwasher with a container for articles to be washed up, having a strainer system arranged in the lower part of the container. The strainer system has a first strainer surface arranged at a higher level than the lowermost part of the container, a flushing system adapted to suck washing liquid through the strainer system from the lower part of the container and to spray this washing liquid into the container through spray nozzles, drainage means for drainage of washing liquid from the lowermost part of the container, and control means adapted to automatically control the flushing system and the drainage means during the washing, which is performed in a plurality of consecutive wash-up steps.

BACKGROUND ART

FIG. 1 shows a dishwasher of the kind to which the present invention relates. It has a container 1 with withdrawable baskets 2 and 3 for the articles to be washed up. A typical use of a machine of this kind is as household dishwasher, whereby the articles to be washed up normally consist of plates, glasses, cutlery, pots, and the like. Below the upper basket 2 an upper spray arm 4 is arranged, which is supplied with flushing water through the pipe 11 during the washing up. The dishwater is sprayed out through a number of spray nozzles 41 on the arm, at least some of these spray nozzles being inclined in order to impart rotation to the spray arm during the flushing. The spray arm is journalled to be easily movable on a stub tube 12 serving as a hub, through which stub tube the flushing water from the pipe 11 flows out into the spray arm through openings 14. In similar manner, the spray arm 5 mounted below the lower basket 3 is mounted to be easily movable on a stub tube 10 serving as a hub, the arm is supplied with dishwater during the flushing through openings 13, and the dishwater flows out through a number of spray nozzles 51 on the arm. The dishwater sprayed out through the nozzles of the spray arms during the flushing runs down into the lower part of the container and is collected in a sump 6. The flushing system includes a circulation pump 8. The pump 8 sucks from the sump 6 through a pipe 7 and pumps the dish water via the pipes 9 and 11 to the two spray arms. To prevent resoiling of the items being washed up, the flushing system is provided with a strainer 15. The strainer 15 has an upper strainer surface slightly inclined towards the center of the strainer as well as a stub tube 152 arranged centrally in the strainer and extending down to the bottom of the sump 6. Both the upper strainer surface 151 and the stub tube 152 are constructed as strainers, for example made of sheet metal and provided with a large number of fine holes.

In the bottom of the sump 6 and below the stub tube 152 of the fine strainer, a waste pipe 16 is arranged through which the dishwater can be drained off with the aid of a discharge pump 17 and an outlet pipe 18. To prevent coarser particles from causing clogging of the discharge pump 17 or the waste pipe 16, a coarse strainer 19 is arranged at the outlet from the dishwasher.

Dish water is supplied to the machine through a supply pipe 20, a controlled movement downwards into the container 1 being imparted to the dishwater by a shield 23. For control of the water supply a solenoid valve 21 is arranged in the supply pipe. The function of the dishwasher is controlled and monitored by a control means 24. In conventional manner, this may consist either of a conventional, rotary electromechanical control means, or of a microprocessor or the like which is provided with suitable input and output means. To start the washing up, select the desired program, and the like, a number of schematically shown operating members 25, 26, 27 are arranged.

A typical water level during any of the washing steps is shown by the horizontal line A in FIG. 1.

The control means 24 controls the washing procedure in a plurality of consecutive washing steps, for example pre-wash, main washing and three rinsings. Before the pre-wash a flushing step may possibly be provided, between the pre-wash and the main washing an intermediate rinsing step may be provided, and after the last rinsing a drying step may be provided during which the washed articles are dried with the aid of heating elements activated by the control means and built into the dishwasher. In addition, the heating elements may be used for heating the admitted dish-water to the desired temperature at the beginning of each washing step.

FIG. 2 shows in more detail the strainer system of the dishwasher as well as the lower spray arm 5. The flushing water is supplied to the spray arm through the stub tube 10 and the openings 13 provided therein. The spray arm rests on a flange 102 on the stub tube 10 and is readily movable around the stub tube. The spray arm has, for example, the three spray nozzles 51*a*, 51*b* and 51*c*, arranged on the upper side, as well as an additional nozzle 51*d* on the underside. The figure shows the fine strainer 15 with its upper strainer surface 151, and the stub tube 152. These two elements may be made of sheet metal and are provided with a large number of relatively fine holes 153, 154. In the lefthand part of the sump 6 a stub tube 71 is provided for connection of the pipe or hose 7 to the circulation pump 8. Similarly, in its central part the sump has a stub tube 161 for connection of the pipe or hose 16 leading to the discharge pump 17. The coarse strainer 19, which is to capture such larger objects that may cause a pump stop, is designed as a coarse-meshed metal or plastic strainer with holes 191 and is suspended from a flange in the stub tube 152 of the fine strainer.

During, for example, the prewash, normally large quantities of dirt are removed from the articles to be washed up. The dirt accompanies the water flowing down into the bottom of the container 1 and remains on the surface of the fine strainer 15, to which it adheres due to the powerful suction action of the circulation pump 8. The soiling is particularly pronounced on the upper strainer surface 151. In known dishwasher a prewash is terminated by the flushing ceasing (the circulation pump 8 being stopped), whereafter the dishwasher is pumped out with the aid of the discharge pump 17. Part of the dirt deposited on the surface of the fine strainer is discharged with the dishwasher whereas part of the dirt remains on the strainer surface. During a subsequent wash-up step, for example the main wash-up succeeding the prewash, this remaining dirt will soil the dishwasher and cause resoiling of the articles being washing. This resoiling requires a relatively large number of rinsings after the main washing, for example three such rinsings. The consumption of water for a complete washing procedure is therefore relatively great. This is a considerable disadvantage since both the water costs and the cost of heating the water are relatively high.

Proposals have been made to introduce extra rinsings after the prewash to rinse away, as far as possible, the dirt removed during the prewash, thus reducing the resoiling during the main washing. However, no reduction of the total number of necessary rinsings and hence of the total water consumption can be obtained in this way. Further, an obvious method of reducing the water consumption would be to reduce the volume of water used during each rinsing. However, it has proved to be difficult to reduce the water consumption in this way, since a volume of water reduced below a certain limit results in the circulation pump sucking air, which leads to a deteriorated flushing action and an increased noise level. Similarly, it has proved to be impossible to reduce the water consumption by reducing the number of rinsings without simultaneously deteriorating the desired good result of the washing.

From DE-A1-2 657 764 a dishwasher of the kind described above is previously known, in which, during the pumping out of washingup liquid after a washing step, the circulation pump is kept running while the liquid is continuously pumped out at least until the liquid level has dropped to below the upper strainer surface of the fine strainer. This is done for the purpose of obtaining a rinsing of the fine strainer. However, tests performed have shown that, in a typical dishwasher, no significant improvement is achieved in this way. No real cleaning of the strainer surface is obtained until, during the pumping out, the liquid surface has dropped to such an extent that the strainer surface is exposed. The remaining quantity of liquid is then so small that the further pumping out is performed very rapidly, and no significant cleaning of the filter surface is ever performed.

EP-A1-222 306 discloses a known dishwasher in which the spray arm has nozzles on its underside which provide a flow of water in the washing liquid with a component parallel to the surface of the fine strainer. In dishwashers of this kind, the liquid level during the wash-up steps is so high that the liquid surface lies above the strainer surface. The proposed method therefore only provides a certain amount of flow in the washing liquid along the strainer surface and only incomplete cleaning of the strainer. The circulation pump working during the wash-up steps has a high capacity and a powerful sucking action. This causes particles of dirt to adhere to the surface of the strainer, which further prevents an efficient cleaning of the strainer.

SUMMARY OF THE INVENTION

The present invention aims to provide a method for cleaning the strainer system of a dishwasher, by means of which, during an early stage of the washing procedure, a very large part of the removed dirt is removed from the dishwasher, whereby the resoiling of the articles being washing during subsequent wash-up steps is greatly reduced and hence the number of required rinsings and hence, in turn, the total water consumption during the whole washing procedure. The invention also aims to provide a device for carrying out this method which allows for considerably reducing the volume of water required for the washing procedure, without deterioration of the washing result.

BRIEF DESCRIPTION OF THE DRAWING

The present invention will be described in greater detail below with reference to the accompanying FIGS. 1–4, wherein.

DESCRIPTION OF THE PREFERRED EMBODIMENT

Figure 1:
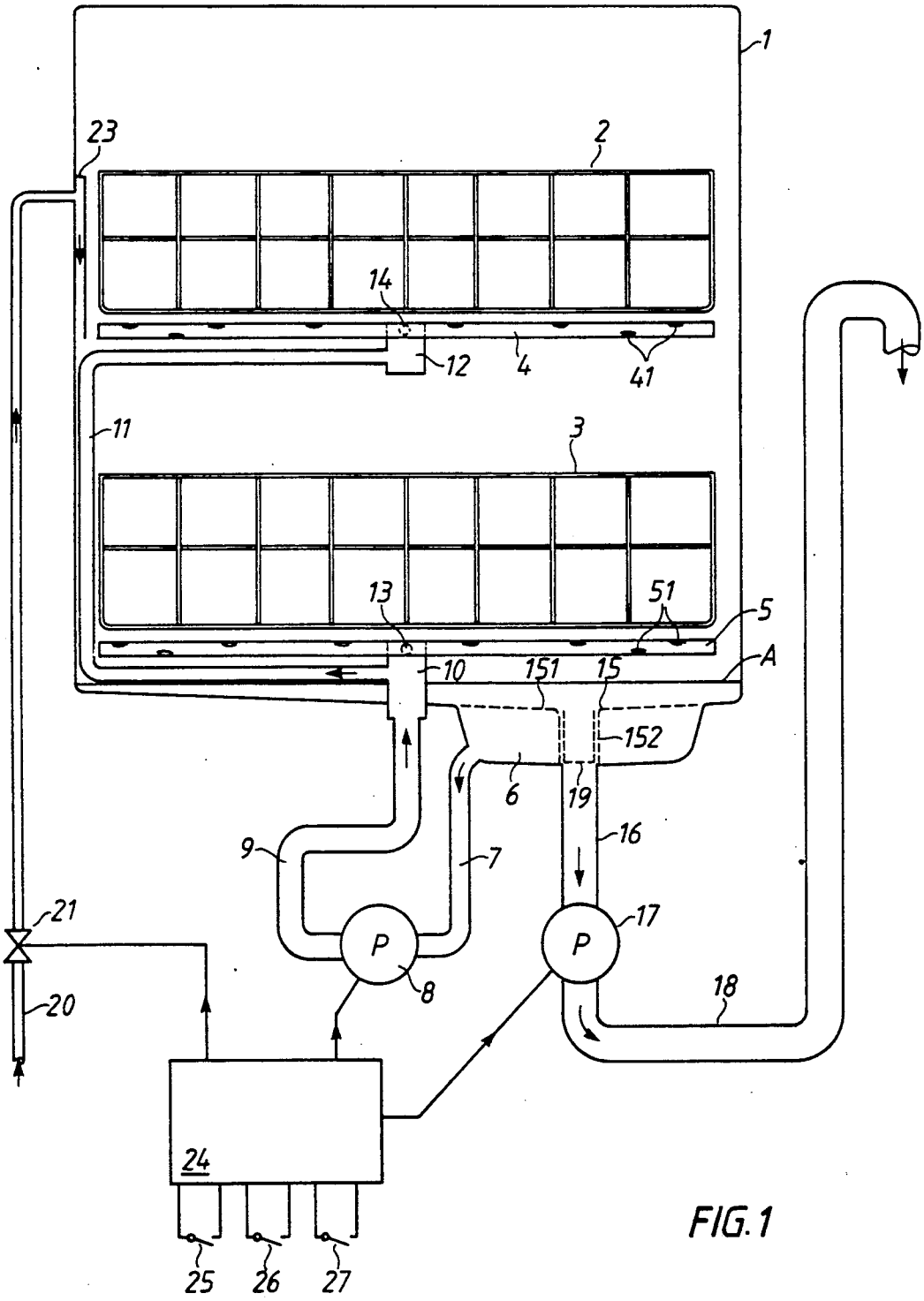
FIG. 1 shows a dishwasher of the kind to which the present invention relates.

An embodiment of the present invention will now be described with reference to FIGS. 1–4. The function diagram in FIG. 4 illustrates an example of a method according to the invention. It is shown there how the circulation pump 8 (CP), the discharge pump 17 (DP) and the inlet valve 21 (IV) are activated during different time intervals during the period from the end of the prewash (t=t1) to the beginning of the main washup (t=t5). The time during which one of these members is activated is shown by a thicker line in FIG. 4.

During the prewash, the circulation pump 8 is activated and circulates dishwater through the flushing system. The dishwater has the level designated A in FIG. 1 and FIG. 2. At t=t1, the prewash is terminated by the circulation pump 8 being stopped. According to a preferred embodiment of the invention, the washing program now takes a pause between t=t1 and t=t2, during which time both the circulation pump 8 and the discharge pump 17 remain inoperative. This time interval may, for example, amount to 40 seconds. During this pause the major part of the dirt which has adhered to the surface of the fine strainer 15, above all its upper surface 151, because of the powerful sucking action of the circulation pump 8, will loosen from the filter and float upwards to the water surface.

When the above-mentioned pause is terminated, the control means 24 starts both the circulation pump 8 and the discharge pump 17 at t=t2. Dishwater is pumped away under simultaneous flushing. During this pumping away, part of the dirt present in the dish-washer tends to float towards the drainage point and be transported away. The pumping out is performed during the interval t=t2 to t=t3, and the duration of this interval is so chosen in relation to the drainage rate that the water level at the end of the interval lies lower than the upper strainer surface 151 of the fine strainer 15. This water level is designated B in FIG. 3. This water level may, for example, correspond to a residual water quantity of 40% of the original water quantity. At some time during this pumping-out interval, therefore, the strainer surface 151 will become exposed, and after that the water stream flowing towards the drainage point provides rinsing away of dirt from the strainer surface 15. The particles of dirt which are rinsed away accompany the water stream down into the stub tube 152 and are transported away by the discharge pump.

Figure 3:
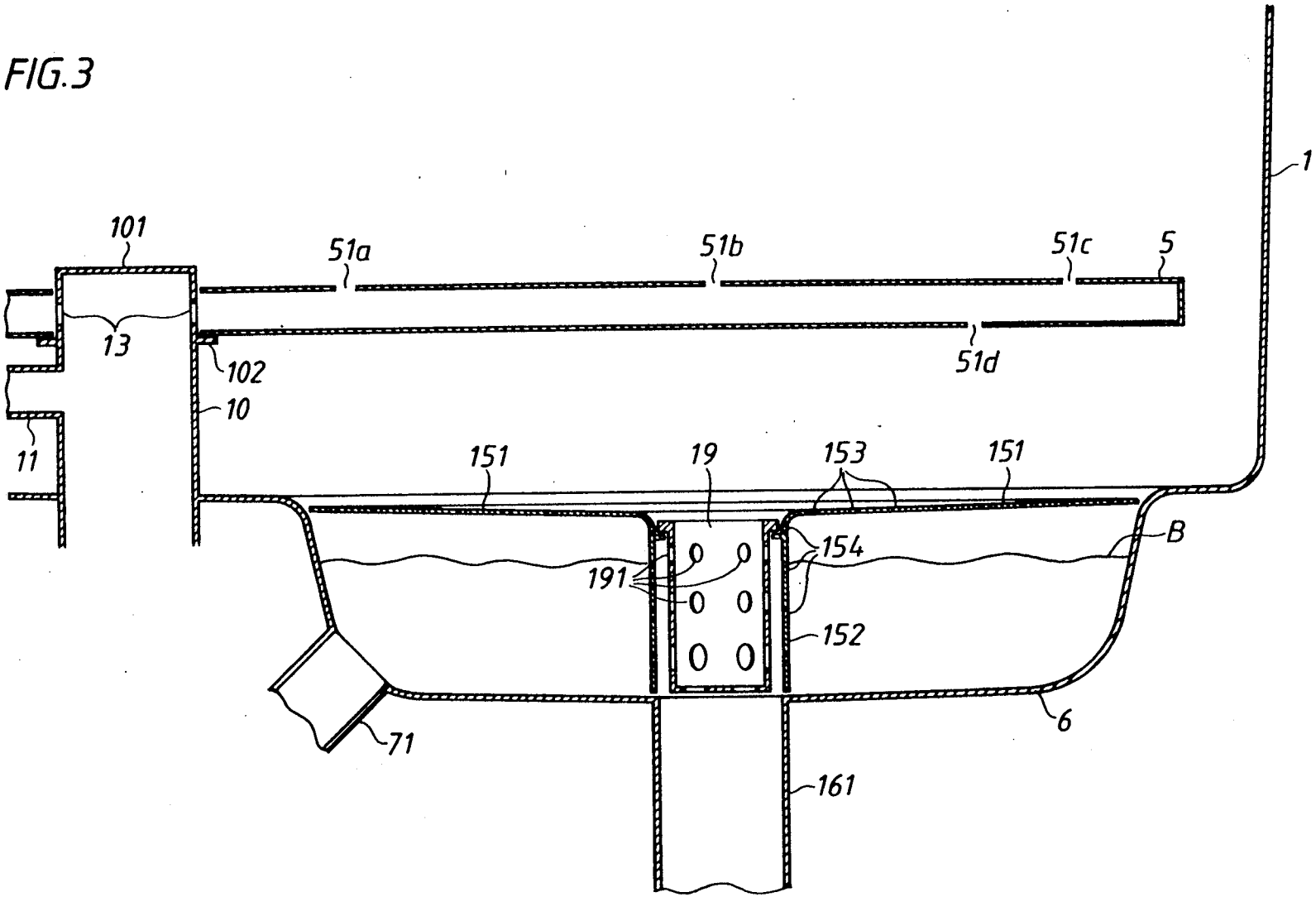
FIG. 3 shows the strainer system of the dishwasher and the level of the water surface when flushing with a reduced water quantity according to the present invention.
Figure 4:
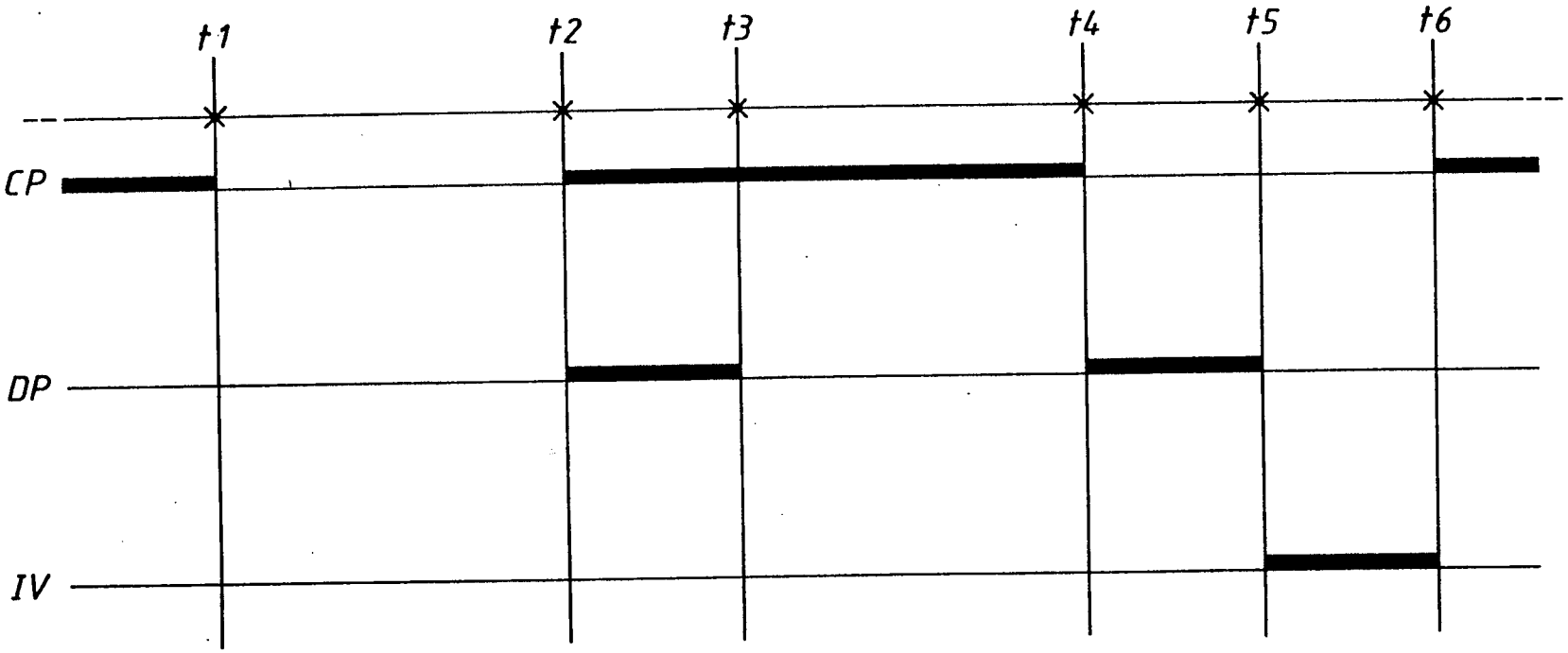
FIG. 4 shows in the form of a function diagram, the function of a dishwasher for carrying out a method according to the invention.

At t=t3, when the desired water level B in FIG. 3 has been reached, the discharge pump 17 is stopped while the flushing is continued during a period of, for example, 40 seconds. During this prolonged interval the upper surface of the fine strainer is all the time exposed to the powerful water stream flowing towards the drainage point, and there is ample time for the water stream to effectively rinse away practically all of the dirt particles present on the strainer surface. These particles are rinsed down into the stub tube 152 where they are collected.

At t=t4, the circulation pump 8 is stopped and the discharge pump 17 started. The residual water quantity, together with dirt particles present in the stub tube 152, are then transported away.

The pumping out continues for such a long time that all dishwater, together with residual dirt particles, has been safely discharged. At t=t5 the discharge pump 17 is stopped and the next washing step can be started. Typically, this constitutes the so-called main wash-up, which is started by the inlet valve 20 being opened, at t=t5, and being held open for such an adapted space of time that the water quantity in the container reaches the desired level. The filling of water is terminated at t=t6, whereafter the flushing system is started and the main washing carried out.

Compared with prior art washing procedures, a considerable reduction of the amount of dirt remaining in the dishwasher after a prewash, or the like, is obtained. This is achieved by the use of dishwater already present in the dishwasher and previously used. No additional supply of dishwater whatsoever is thus required to achieve this effect. The greatly reduced amount of dirt means that the water which is used during a subsequent washing step, typically the main washing, will be much cleaner than what has previously been the case. This in turn means that the so-called resoiling of the articles being washed up is greatly reduced and hence also the need of a subsequent rinsing step. It has proved that with a washing method according to the invention, the number of rinsings following the main washing can be reduced from three to two. Further, it has proved that the water quantity used during each washing step can be reduced, typically by about 20%. These combined effects allow for the reduction of the total water consumption for a washing procedure in the present method by, for example, about 35%. It has further been, found that this considerable reduction of the water consumption can be obtained without any deterioration of the washing result.

The cleaning method according to the invention provides the greatest effect when performed after the prewash or a corresponding wash-up step, since it is at this stage that a considerable quantity of loose dirt is rinsed away from the articles being washed up. It is self-evident, however, that the cleaning method can be carried out, as an alternative or as a complement, after the main washing.

Figure 2:
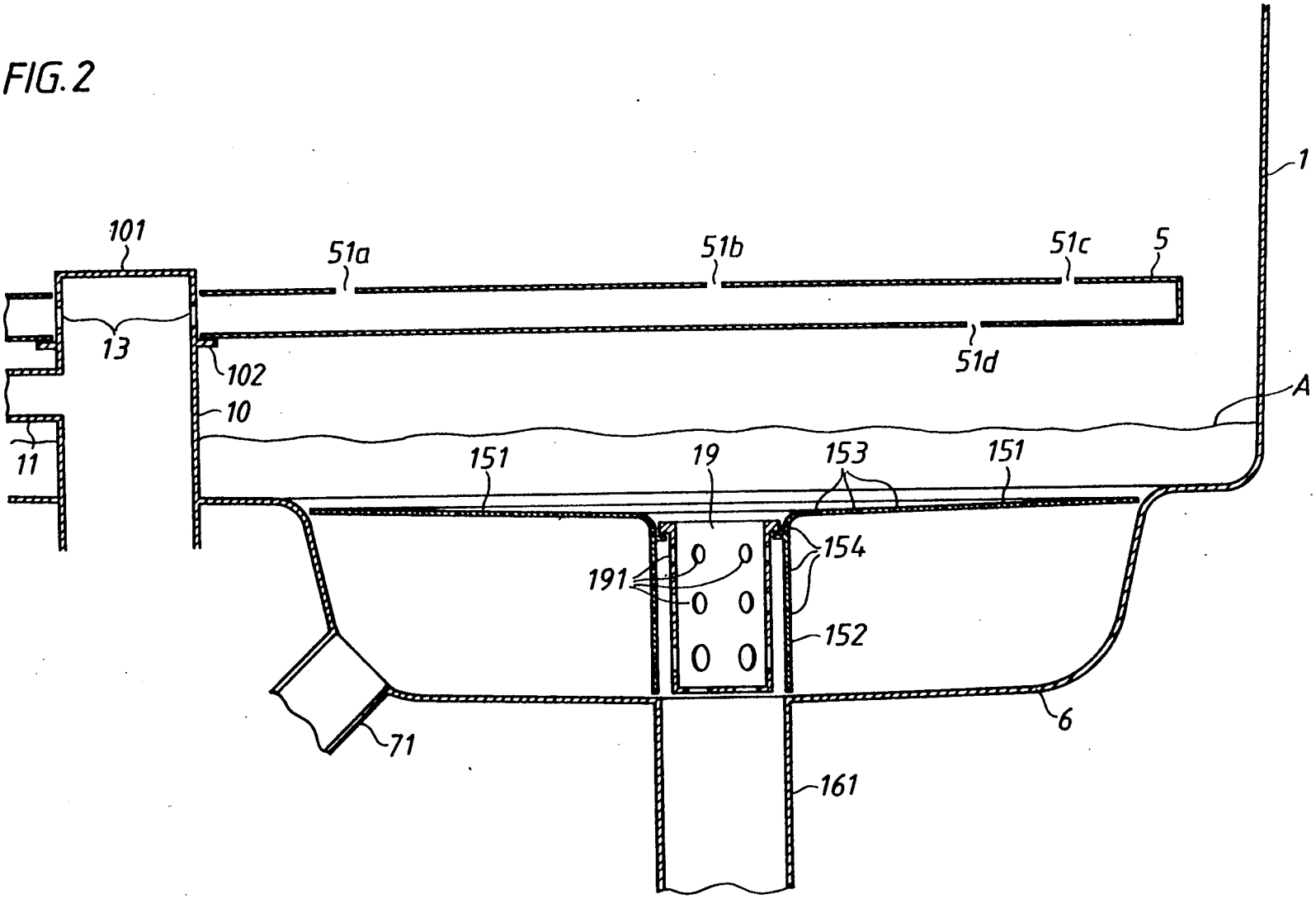
FIG. 2 shows in more detail the strainer system of the dishwasher.

FIGS. 2 and 3 show how the lower spray arm 5 is provided on its underside with a spray nozzle **51*d*, through which water is flushed downwards. The flushing from this spray nozzle provides an additional improvement of the cleaning of the upper surface of the fine strainer. If desired, in order to further enhance the flushing effect on the strainer, the underside of the spray arm 5** can, of course, be provided with more spray nozzles than the only one shown.

In the embodiment described above, the drainage of the dishwater has taken place with the aid of a discharge pump. In those cases where a level difference need not be overcome, the dishwater may, of course, be drained off by being discharged, through a solenoid valve or the like, downwards to a floor drain or the like.

If the foregoing description the designation "dishwater" has been used for the liquid used during the washing, which liquid normally consists of water or an aqueous solution of a detergent. Also other washing-up liquids can, of course, be used, for example in those cases where a dishwasher is utilized for cleaning in industry.

We claim:

1. A dishwasher comprising:

a container for articles to be washed;

a strainer system arranged in a lower part of the container, said strainer system having a first strainer surface arranged at a higher level than a lowermost part of the container;

a flushing system adapted to receive a washing liquid through the strainer system from the lower part of the container and to spray this liquid into the container through spray nozzles;

drainage means for drainage of washing liquid from the lowermost part of the container; and control means for automatically controlling the flushing system and the drainage means during the washing procedure, which is to be performed in a plurality of consecutive washing steps, said control means being adapted, after one of said washing steps, to control the drainage means for partial drainage of said washing liquid, and for interruption of said partial drainage when such a quantity of washing liquid has been drained off that said first strainer surface is exposed, but leaving a residual amount of washing liquid in the container after the interruption of said partial drainage, and for activating said flushing system for cleaning of said strainer system by circulation of said residual amount of washing liquid through the flushing system, whereby reducing the amount of washing liquid required for the washing procedure.

2. A dishwasher according to claim 1, wherein said control means deactivates said flushing system before the partial drainage to interrupt the circulation of washing liquid during a predetermined time interval such as to enable particles present in the strainer system to be released from the surface of the strainer.

3. A dishwasher according to claim 2, wherein said control means is adapted, after interruption of the partial drainage, to activate the flushing system for circulation of the washing liquid through the flushing system during a predetermined time interval.

4. A dishwasher according to claim 2, wherein said flushing system comprises a movable spray arm arranged immediately above the bottom of the container and is provided with spray nozzles on its upper side for flushing of articles to be washed which are located above the spray arm, said spray arm also being provided with spray nozzles on its underside for flushing of the upper surface of the strainer.

5. A dishwasher according to claim 1, wherein said control means is adapted to activate the flushing system for circulation of the washing liquid through the flushing system during the drainage of the washing liquid.

6. A dishwasher according to claim 5, wherein the control means is adapted to activate the partial drainage and cleaning of the strainer system with said residual amount of washing liquid between the first pre-washing step in a washing program and the immediately succeeding washing step.

7. A dishwasher according to claim 1, wherein said control means is adapted, after interruption of the drainage, to activate the flushing system for circulation of the residual washing liquid through the flushing system during a predetermined time interval.

8. A dishwasher according to claim 1, wherein said control means is adapted to activate the partial drainage and cleaning of the strainer system with said residual amount of washing liquid between the first washing step in a washing program and an immediately succeeding second washing step.

9. A dishwasher according to claim 1, wherein said flushing system comprises a movable spray arm arranged immediately above the bottom of the container and provided with spray nozzles on its upper side for flushing of articles to be washed which are located above the spray arm, said spray arm also being provided with spray nozzles on its underside for flushing of the upper surface of the strainer.

10. A dishwasher including:

a container for articles to be washed;

a strainer system provided in a lower part of the container, said strainer system having a first strainer surface positioned at a higher level than a lowermost part of the container;

a flushing system adapted for receiving a washing liquid through the strainer system from the lower part of the container and spraying said liquid into the container through spray nozzles;

drainage means for drainage of washing liquid from the lowermost part of the container; and control means for automatically controlling the flushing system and the drainage means during a plurality of consecutive washing steps of the washing procedure, said control means being adapted for controlling the drainage means after at least one of said washing steps, for partial drainage of said washing liquid, and for interruption of said partial drainage after a predetermined time interval during which a predetermined quantity of washing liquid has been drained off to expose said first strainer surface, but leaving a residual amount of washing liquid in the container after the interruption of said partial drainage, and for activating said flushing system for cleaning of said strainer system by circulation of said residual amount of washing liquid through the flushing system after interruption of said partial drainage.

11. A dishwasher according to claim 10, wherein said control means deactivates said flushing system before the partial drainage to interrupt the circulation of washing liquid during a predetermined time interval such as to enable particles present in the strainer system to be released from the surface of the strainer.

12. A dishwasher according to claim 10, wherein said flushing system comprises a movable spray arm arranged immediately above the bottom of the container and provided with spray nozzles on its upper side for flushing of articles to be washed which are located above the spray arm, said spray arm also being provided with spray nozzles on its underside for flushing of the upper surface of the strainer.

* * * * *